US009038749B2

(12) United States Patent
Radford et al.

(10) Patent No.: US 9,038,749 B2
(45) Date of Patent: May 26, 2015

(54) TOOLS FOR USE IN SUBTERRANEAN BOREHOLES HAVING EXPANDABLE MEMBERS AND RELATED METHODS

(71) Applicant: Baker Hughes Incorporated, Houston, TX (US)

(72) Inventors: Steven R. Radford, The Woodlands, TX (US); Khoi Q. Trinh, Pearland, TX (US); Li Li, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/447,920

(22) Filed: Jul. 31, 2014

(65) Prior Publication Data

US 2014/0338981 A1 Nov. 20, 2014

Related U.S. Application Data

(62) Division of application No. 13/025,884, filed on Feb. 11, 2011, now Pat. No. 8,820,439.

(51) Int. Cl.
*E21B 10/32* (2006.01)
*E21B 7/28* (2006.01)

(52) U.S. Cl.
CPC ..... *E21B 10/325* (2013.01); *E21B 10/322* (2013.01); *E21B 7/28* (2013.01)

(58) Field of Classification Search
CPC ..... E21B 10/322; E21B 10/325; E21B 10/26; E21B 10/32; E21B 10/46; E21B 34/14; E21B 7/28
USPC ..... 175/57, 269, 267, 385, 285, 291, 268
See application file for complete search history.

(56) References Cited

U.S. PATENT DOCUMENTS

| | | | |
|---|---|---|---|
| 4,635,738 | A | 1/1987 | Schillinger et al. |
| 5,402,856 | A | 4/1995 | Warren et al. |
| 5,495,899 | A | 3/1996 | Pastusek |
| 5,957,223 | A | 9/1999 | Doster et al. |
| RE36,817 | E | 8/2000 | Pastusek |
| 6,360,831 | B1 | 3/2002 | Akesson et al. |

(Continued)

OTHER PUBLICATIONS

Radford et al., Novel Concentric Expandable Stabilizer Results in Increased Penetration Rates and Drilling Efficiency with Reduced Vibration, SPE/IADC 119534 Drilling Conference and Exhibition, 2009, 13 pages.

(Continued)

*Primary Examiner* — Daniel P Stephenson
(74) *Attorney, Agent, or Firm* — TraskBritt

(57) ABSTRACT

Expandable apparatus for use in subterranean boreholes include at least one member configured to move between a retracted position and an extended position. Components of the expandable apparatus may include at least one surface for removing debris proximate to the tubular body. Components of the expandable apparatus may be configured to enable the expandable apparatus to increase a diameter of a subterranean borehole by greater than twenty percent. Components of the expandable apparatus may be configured to restrict fluid flow to nozzle assemblies. The expandable apparatus may include a protect sleeve having a push sleeve disposed therein. Methods of operating an expandable apparatus may include removing debris with a surface of the expandable apparatus. Methods of operating an expandable apparatus may also include selectively flowing fluid to nozzle assemblies.

15 Claims, 7 Drawing Sheets

(56) References Cited

U.S. PATENT DOCUMENTS

| | | | |
|---|---|---|---|
| 7,036,611 | B2 | 5/2006 | Radford et al. |
| 7,308,937 | B2 | 12/2007 | Radford et al. |
| 7,314,099 | B2 | 1/2008 | Dewey et al. |
| 8,230,951 | B2 | 7/2012 | Radford et al. |
| 2005/0205305 | A1 | 9/2005 | Stout et al. |
| 2008/0102175 | A1 | 5/2008 | Jeon et al. |
| 2008/0105464 | A1 | 5/2008 | Radford |
| 2008/0105465 | A1 | 5/2008 | Radford et al. |
| 2008/0110678 | A1 | 5/2008 | Radford et al. |
| 2008/0128169 | A1 | 6/2008 | Radford et al. |
| 2008/0128175 | A1 | 6/2008 | Radford et al. |
| 2009/0145666 | A1 | 6/2009 | Radford et al. |
| 2010/0276199 | A1 | 11/2010 | Radford |
| 2011/0073330 | A1 | 3/2011 | Radford |
| 2011/0073376 | A1 | 3/2011 | Radford et al. |
| 2012/0111579 | A1 | 5/2012 | Radford et al. |
| 2012/0205157 | A1 | 8/2012 | Radford et al. |

OTHER PUBLICATIONS

Radford et al., U.S. Appl. No. 61/411,201, entitled Earth-Boring Tools Having Expandable Members and Related Methods, filed Nov. 8, 2010.

International Preliminary Report on Patentability for International Application No. PCT/US2012/024318 dated Aug. 13, 2013, 5 pages.

International Search Report for International Application No. PCT/US2012/024318 dated Oct. 8, 2012, 4 pages.

International Written Opinion for International Application No. PCT/US2012/024318 dated Oct. 8, 2012, 4 pages.

TOOLS FOR USE IN SUBTERRANEAN BOREHOLES HAVING EXPANDABLE MEMBERS AND RELATED METHODS

CROSS-REFERENCE TO RELATED APPLICATION

This application is a divisional of U.S. patent application Ser. No. 13/025,884, filed Feb. 11, 2011, now U.S. Pat. No. 8,820,439, issued Sep. 2, 2014, the disclosure of which is hereby incorporated herein in its entirety by this reference.

TECHNICAL FIELD

Embodiments of the present disclosure relate generally to an expandable apparatus for use in a subterranean borehole and, more particularly, to an expandable reamer apparatus for enlarging a subterranean borehole and to an expandable stabilizer apparatus for stabilizing a bottom-hole assembly during a drilling operation and to related methods.

BACKGROUND

Expandable reamers are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present disclosure. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present disclosure.

Another conventional approach used to enlarge a subterranean borehole includes employing an extended bottom-hole assembly with a pilot drill bit at the distal end thereof and a reamer assembly some distance above the pilot drill bit. This arrangement permits the use of any conventional rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom-hole assembly is particularly significant in directional drilling. The assignee of the present disclosure has, to this end, designed as reaming structures so called "reamer wings," which generally comprise a tubular body having a fishing neck with a threaded connection at the top thereof and a tong die surface at the bottom thereof, also with a threaded connection. U.S. Pat. Nos. RE36,817 and U.S. Pat. No. 5,495,899, both of which are assigned to the assignee of the present disclosure, disclose reaming structures including reamer wings. The upper midportion of the reamer wing tool includes one or more longitudinally extending blades projecting generally radially outwardly from the tubular body and PDC cutting elements are provided on the blades.

As mentioned above, conventional expandable reamers may be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Akesson et al., discloses a conventional borehole opener comprising a body equipped with at least two hole opening having cutting means that may be moved from a position of rest in the body to an active position by exposure to pressure of the drilling fluid flowing through the body. The blades in these reamers are initially retracted to permit the tool to be run through the borehole on a drill string, and, once the tool has passed beyond the end of the casing, the blades are extended so the bore diameter may be increased below the casing.

BRIEF SUMMARY

In some embodiments, the present disclosure includes an expandable apparatus for use in a subterranean borehole. The expandable apparatus includes a tubular body having a longitudinal bore and at least one opening in a wall of the tubular body. At least one member is positioned within the at least one opening in the wall of the tubular body and configured to move between a retracted position and an extended position. A yoke is coupled to the at least one member. At least one of the yoke and the tubular body comprises at least one surface having a central portion comprising an apex for removing debris proximate to the at least one opening in the wall of the tubular body.

In additional embodiments, the present disclosure includes an expandable apparatus for use in a subterranean borehole. The expandable apparatus includes a tubular body having at least two openings extending between a longitudinal bore of the tubular body and an outer surface of the tubular body. At least two members are each positioned within one opening of the at least two openings of the tubular body and are configured to move between a retracted position and an extended position. The at least two members are substantially disposed within the tubular body when in the retracted position. A push sleeve is disposed within the longitudinal bore of the tubular body and coupled to the at least one member. The push sleeve is configured to move the at least two members from the retracted position to the extended position responsive to a flow rate of drilling fluid passing through the longitudinal bore. A traveling sleeve is positioned within the longitudinal bore of the tubular body and partially within the push sleeve. The traveling sleeve is configured to secure the push sleeve from axial movement within the tubular body in an initial position. The tubular body, the push sleeve, and the traveling sleeve are sized and configured to enable the at least two members to be sized and configured to increase a diameter of a subterranean borehole by greater than twenty percent (20%).

In yet additional embodiments, the present disclosure includes an expandable apparatus for use in a subterranean borehole. The expandable apparatus includes a tubular body having a longitudinal bore and at least one opening in a wall of the tubular body. At least one member is positioned within the at least one opening in the wall of the tubular body and configured to move between a retracted position and an extended position. At least one nozzle assembly is positioned in the tubular body proximate to the at least one member and is in fluid communication with the longitudinal bore of the tubular body. A traveling sleeve is positioned within the longitudinal bore of the tubular body and comprises an uphole portion configured to at least partially restrict fluid flow through the at least one nozzle assembly by abutting a portion of the tubular body when the traveling sleeve is in an initial position and to at least partially enable fluid flow when the traveling sleeve is in a triggered position.

In yet additional embodiments, the present disclosure includes an expandable apparatus for use in a subterranean borehole. The expandable apparatus includes a tubular body having a longitudinal bore and at least one opening in a wall of the tubular body. At least one member is positioned within the at least one opening in the wall of the tubular body and configured to move between a retracted position and an extended position. A protect sleeve is disposed within the longitudinal bore of the tubular body. A push sleeve is disposed within the longitudinal bore of the tubular body and positioned at least partially within the protect sleeve. The push sleeve is coupled to the at least one member and is configured to move the at least one member from the retracted position to the extended position responsive to a flow rate of drilling fluid passing through the longitudinal bore.

In yet additional embodiments, the present disclosure includes a method for operating an expandable apparatus for use in a subterranean borehole. The method includes moving at least one member of the expandable apparatus coupled to a yoke from a retracted position to an extended position against a biasing force of a spring disposed in the expandable apparatus to compress the spring, forcing the at least one member and the yoke from the extended position to the retracted position with the biasing force of the spring; and removing debris from an exterior of the expandable apparatus proximate to the at least one member with at least one surface of at least one of the yoke and the tubular body having a central portion comprising an apex and with the biasing force of the spring.

In yet additional embodiments, the present disclosure includes a method for operating an expandable apparatus for use in a subterranean borehole. The method includes securing at least one member of the expandable apparatus in a retracted position with a traveling sleeve disposed within a tubular body of the expandable apparatus, moving the traveling sleeve within the tubular body of the expandable apparatus to unsecure the at least one member, moving the at least one member of the expandable apparatus from the retracted position to an extended position, and flowing drilling fluid passing through a longitudinal bore of the tubular body through at least one nozzle assembly positioned in the longitudinal bore of the tubular body proximate to the at least one member while the at least one member is in the retracted position and in the extended position.

In yet additional embodiments, the present disclosure includes a method for operating an expandable apparatus for use in a subterranean borehole. The method includes securing at least one member of the expandable apparatus in a retracted position with a traveling sleeve disposed within a tubular body of the expandable apparatus, moving the traveling sleeve within the tubular body of the expandable apparatus to unsecure the at least one member, moving the at least one member of the expandable apparatus from the retracted position to an extended position, restricting drilling fluid passing through a longitudinal bore of the tubular body from flowing through at least one nozzle assembly positioned in the longitudinal bore of the tubular body proximate to the at least one member while the at least one member is in the retracted position, and flowing a drilling fluid passing through the longitudinal bore of the tubular body through at least one nozzle assembly while the at least one member is in the extended position.

BRIEF DESCRIPTION OF THE DRAWINGS

While the specification concludes with claims particularly pointing out and distinctly claiming what are regarded as embodiments of the disclosure, various features and advantages of embodiments of the disclosure may be more readily ascertained from the following description of some embodiments of the disclosure, when read in conjunction with the accompanying drawings, in which:

DETAILED DESCRIPTION

The illustrations presented herein are, in some instances, not actual views of any particular earth-boring tool, expandable apparatus, cutting element, or other feature of an earth-boring tool, but are merely idealized representations that are employed to describe embodiments the present disclosure. Additionally, elements common between figures may retain the same numerical designation.

As used herein, the terms "distal" and "proximal" are relative terms used to describe portions of an expandable apparatus or members thereof with reference to a borehole being drilled. For example, a "distal" portion of an expandable apparatus is the portion in closer relative proximity to the downhole portion of the borehole (e.g., relatively closer to the furthest extent of the borehole and the furthest extent of a drill string extending into the borehole) when the expandable apparatus is disposed in a wellbore extending into a formation during a drilling or reaming operation. A "proximal" portion of an expandable apparatus is the portion in closer relative proximity to the uphole portion of the borehole (e.g., relatively more distant from the furthest extent of the borehole and the furthest extent of a drill string extending into the borehole) when the expandable apparatus is disposed in a wellbore extending into the formation during a drilling or reaming operation.

In some embodiments, the expandable apparatus described herein may be similar to the expandable apparatus described in, for example, United States Patent Application Publication No. US 2008/0102175 A1, entitled "Expandable Reamers for Earth-Boring Applications," and filed Dec. 3, 2007; U.S. patent application Ser. No. 12/570,464, entitled "Earth-Boring Tools having Expandable Members and Methods of Making and Using Such Earth-Boring Tools," and filed Sep. 30, 2009, now U.S. Pat. No. 8,230,951, issued Jul. 31, 2012; U.S. patent application Ser. No. 12/894,937, entitled "Earth-Boring Tools having Expandable Members and Related Methods," and filed Sep. 30, 2010, now U.S. Pat. No. 8,727,041, issued May 20, 2014; and U.S. Provisional Patent Application No. 61/411,201, entitled "Earth-Boring Tools having Expandable Members and Related Methods," and filed Nov. 8, 2010, the disclosure of each of which is incorporated herein in its entirety by this reference.

Figure 1:
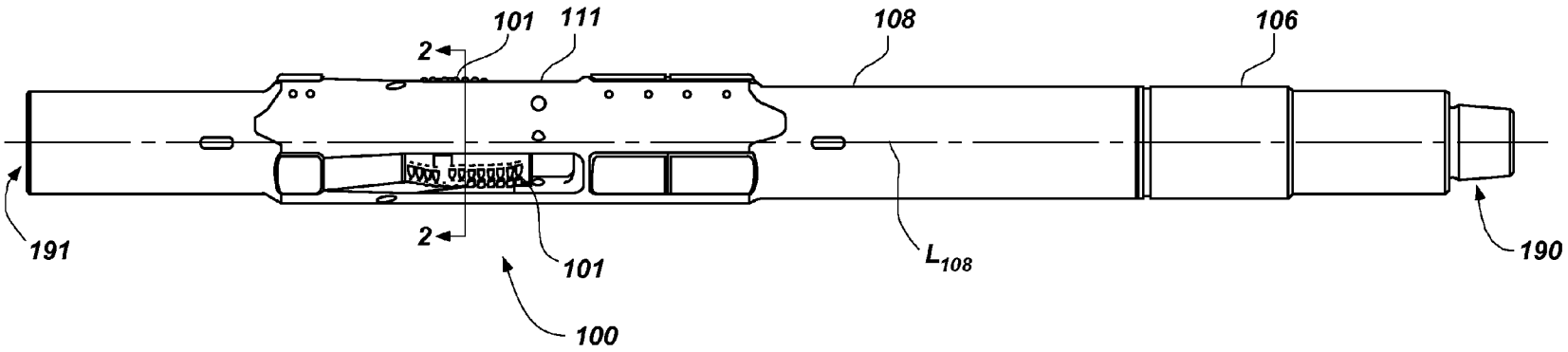
FIG. 1 is a side view of an embodiment of an expandable reamer apparatus in accordance with an embodiment of the present disclosure.

An embodiment of an expandable apparatus (e.g., an expandable reamer apparatus 100) is shown in FIG. 1. The expandable reamer apparatus 100 may include a generally cylindrical tubular body 108 having a longitudinal axis $L_{108}$. The tubular body 108 of the expandable reamer apparatus 100 may have a distal end 190, a proximal end 191, and an outer surface 111. The distal end 190 of the tubular body 108 of the expandable reamer apparatus 100 may include a set of threads (e.g., a threaded male pin member) for connecting the distal end 190 to another section of a drill string or another component of a bottom-hole assembly (BHA), such as, for example, a drill collar or collars carrying a pilot drill bit for drilling a well bore. In some embodiments, the expandable reamer apparatus 100 may include a lower sub 106 that connects to the lower box connection of the reamer body 108. Similarly, the proximal end 191 of the tubular body 108 of the expandable reamer apparatus 100 may include a set of threads (e.g., a threaded female box member) for connecting the proximal end 191 to another section of a drill string or another component of a bottom-hole assembly (BHA). It is noted that while the embodiment of FIG. 1 illustrates an expandable reamer apparatus 100 carrying blades 101, the expandable apparatus may comprises other apparatus such as, for example, an expandable stabilizer apparatus carrying stabilizer blocks thereon for stabilizing a drilling assembly during a drilling operation.

Figure 3:
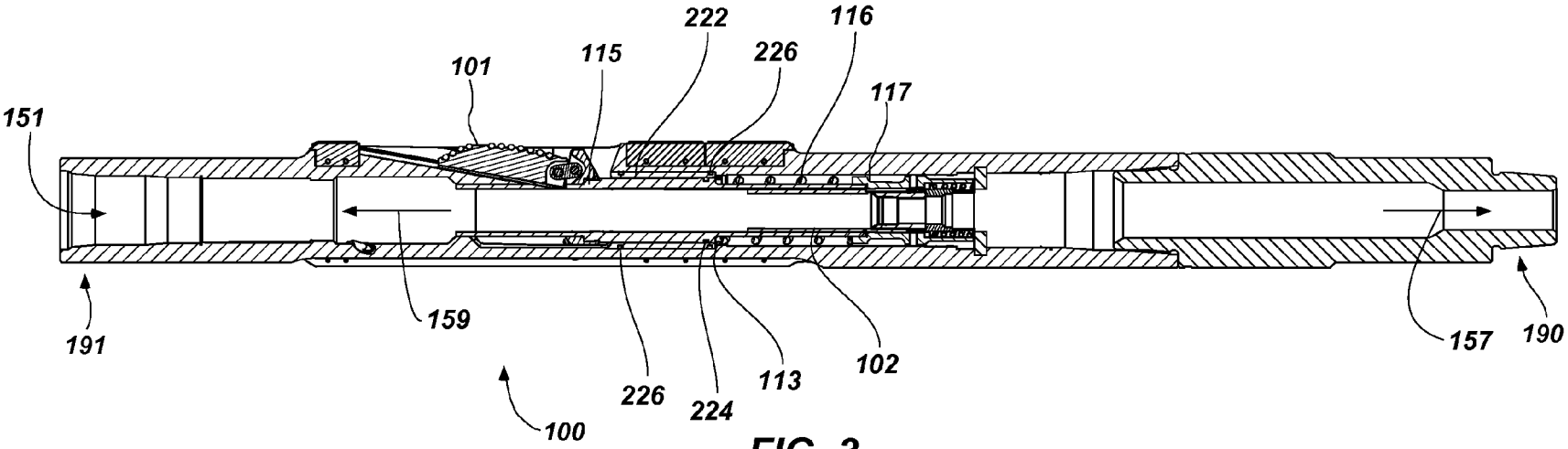
FIG. 3 shows a longitudinal cross-sectional view of the expandable reamer apparatus as indicated by section line 3-3 in FIG. 2.
Figure 6:
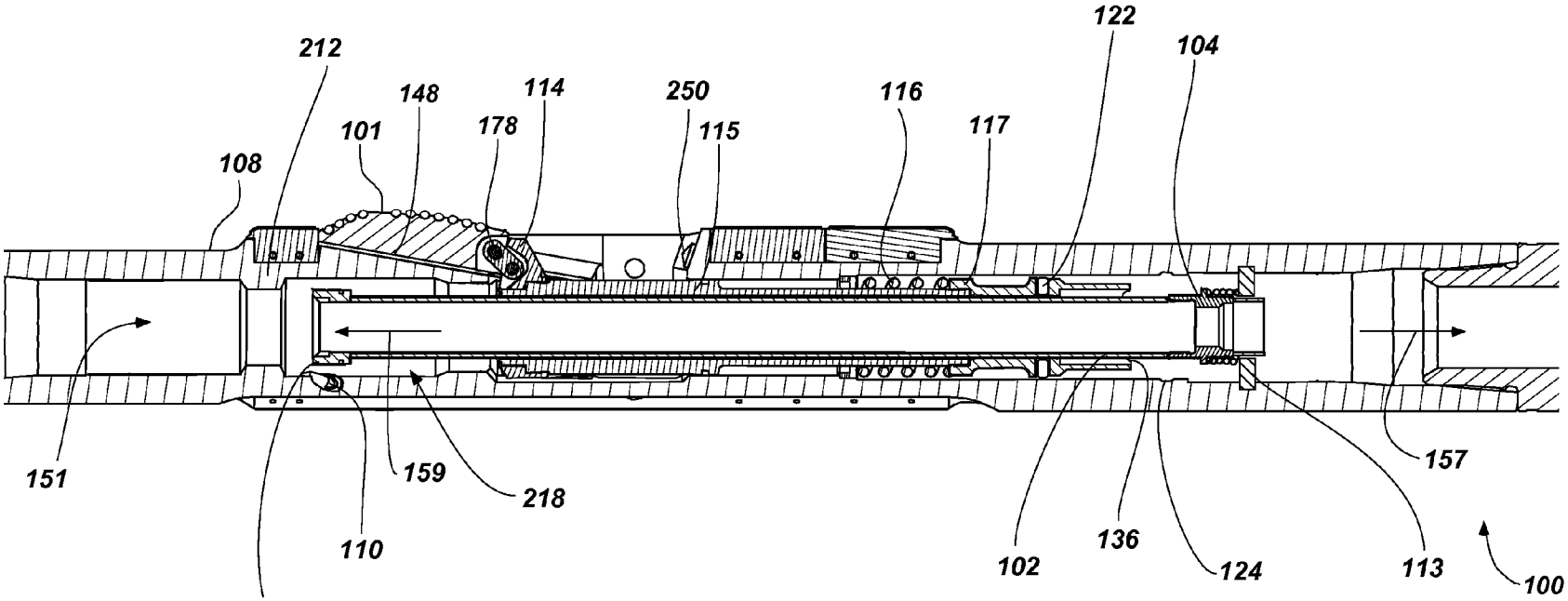
FIG. 6 shows a partial, longitudinal cross-sectional illustration of another embodiment of an expandable reamer apparatus in an expanded position.

Three sliding members (e.g., blades 101, stabilizer blocks, etc.) are positionally retained in circumferentially spaced relationship in the tubular body 108 as further described below and may be provided at a position along the expandable reamer apparatus 100 intermediate the first distal end 190 and the second proximal end 191. The blades 101 may be comprised of steel, tungsten carbide, a particle-matrix composite material (e.g., hard particles dispersed throughout a metal matrix material), or other suitable materials as known in the art. The blades 101 are retained in an initial, retracted position within the tubular body 108 of the expandable reamer apparatus 100, as illustrated in FIG. 3, but may be moved responsive to application of hydraulic pressure into the extended position, as illustrated in FIG. 6, and returned to the retracted position when desired, as will be described herein. The expandable reamer apparatus 100 may be configured such that the blades 101 engage the walls of a subterranean formation surrounding a well bore in which expandable reamer apparatus 100 is disposed to remove formation material when the blades 101 are in the extended position, but are not operable to engage the walls of a subterranean formation within a well bore when the blades 101 are in the retracted position. While the expandable reamer apparatus 100 includes three blades 101, it is contemplated that one, two or more than three blades may be utilized to advantage. Moreover, while the blades 101 of expandable reamer apparatus 100 are symmetrically circumferentially positioned about the longitudinal axis $L_{108}$ along the tubular body 108, the blades 101 may also be positioned circumferentially asymmetrically as well as asymmetrically about the longitudinal axis $L_{108}$. The expandable reamer apparatus 100 may also include a plurality of stabilizer pads to stabilize the tubular body 108 of expandable reamer apparatus 100 during drilling or reaming processes. For example, the expandable reamer apparatus 100 may include upper hard face pads, mid hard face pads, and lower hard face pads.

Figure 2:
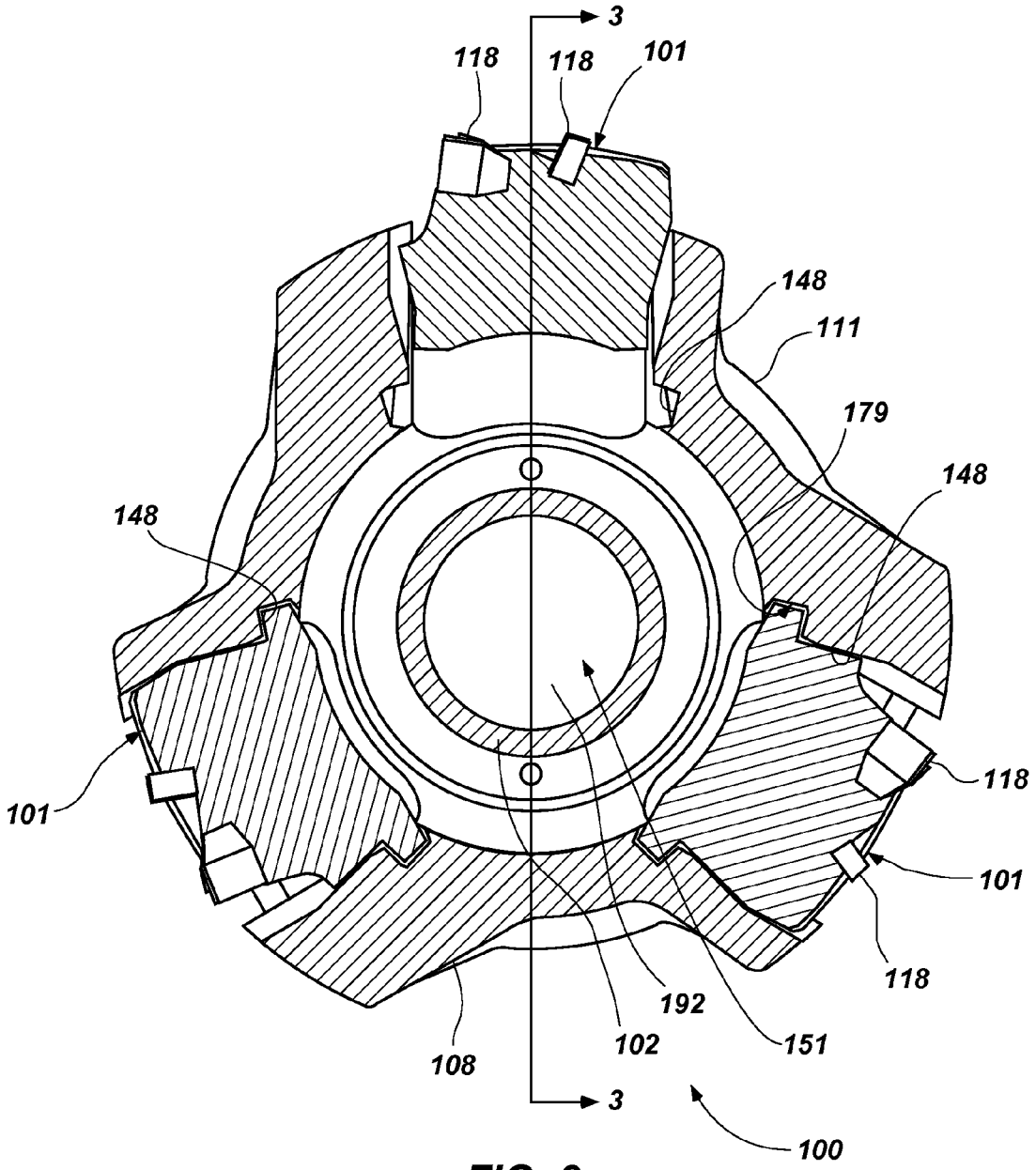
FIG. 2 shows a transverse cross-sectional view of the expandable reamer apparatus as indicated by section line 2-2 in FIG. 1.

FIG. 2 is a cross-sectional view of the expandable reamer apparatus 100 shown in FIG. 1, taken along section line 2-2 shown therein. As shown in FIG. 2, the elongated cylindrical wall of the tubular body 108 encloses a fluid passageway 192 that extends longitudinally through the tubular body 108. Fluid may travel through the fluid passageway 192 in a longitudinal bore 151 of the tubular body 108 (and a longitudinal bore of a sleeve member).

Referring still to FIG. 2, to better describe aspects of embodiments of the disclosure, one of blades 101 is shown in the outward or extended position while the other blades 101 are shown in the initial or retracted positions. In the retracted or recessed position, the blades 101 of the expandable reamer apparatus 100 may be substantially disposed within the tubular body 108 of the expandable reamer apparatus 100. For example, the expandable reamer apparatus 100 may be configured such that the outermost radial or lateral extent of each of the blades 101 is recessed within the tubular body 108 when in the initial or retracted positions so as to not extend beyond the greatest extent of outer diameter of the tubular body 108. Such an arrangement may protect the blades 101 as the expandable reamer apparatus 100 is disposed within a casing of a borehole, and may enable the expandable reamer apparatus 100 to pass through such casing within a borehole. In other embodiments, the outermost radial extent of the blades 101 may coincide with or slightly extend beyond the outer diameter of the tubular body 108. The blades 101 may extend beyond the outer diameter of the tubular body 108 when in the extended position, for example, to engage the walls of a borehole in a reaming operation.

The three sliding blades 101 may be retained in three blade tracks 148 formed in the tubular body 108. The blades 101 each carry a plurality of cutting elements 118 for engaging the material of a subterranean formation defining the wall of an open borehole when the blades 101 are in an extended position (shown in FIG. 3). The cutting elements 118 may be polycrystalline diamond compact (PDC) cutters or other cutting elements known in the art.

Optionally, one or more of the blades 101 may be replaced with stabilizer blocks having guides and rails as described herein for being received into grooves 179 of the track 148 in the expandable reamer apparatus 100, which may be used as expandable concentric stabilizer rather than a reamer, which may further be utilized in a drill string with other concentric reamers or eccentric reamers.

FIG. 3 shows a longitudinal cross-sectional view of the expandable reamer apparatus 100 as indicated by section line 3-3 in FIG. 2. The expandable reamer apparatus 100 may include an actuating feature, such as a push sleeve 115 coupled to extendable and retractable blades 101. The actuating feature of the reamer apparatus 100 may also include a latch sleeve 117 coupled to the push sleeve 115. In some embodiments, the latch sleeve 117 may be formed as a portion of the push sleeve 115. The push sleeve 115 may be directly or indirectly coupled (e.g., by a linkage) to the one or more blades 101 of the expandable reamer apparatus 100. As discussed below in further detail, the push sleeve 115 may move in the uphole direction 159 in order to transition the blades 101 between the extended and retracted position. The blades 101 of the expandable reamer apparatus 100 may be retained in a retracted position by a retaining feature such as a sleeve member (e.g., a traveling sleeve 102).

Figure 4:
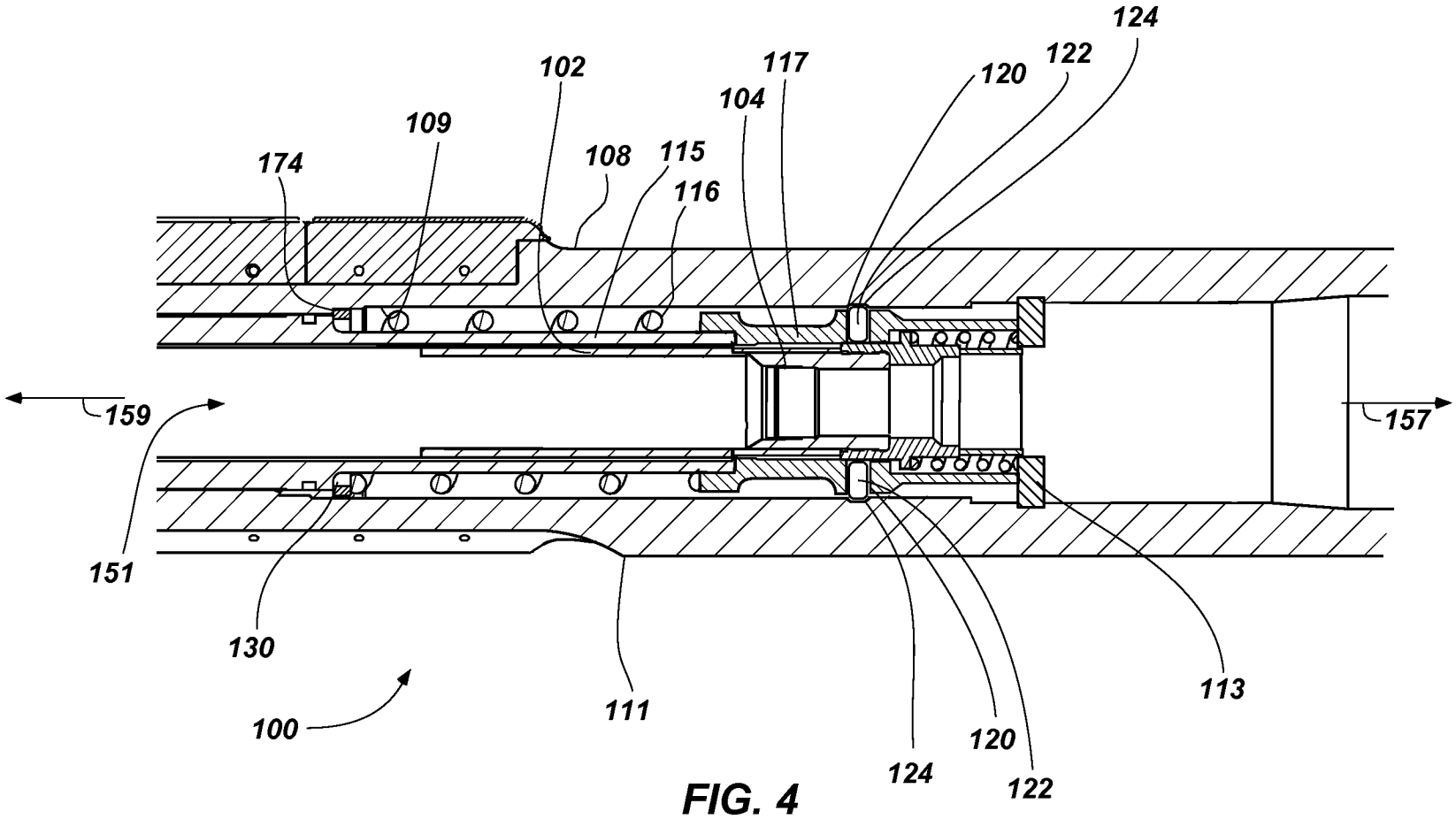
FIG. 4 shows an enlarged cross-sectional view of a downhole portion of the expandable reamer apparatus shown in FIG. 3.

As shown in FIG. 4, the expandable reamer apparatus 100 may include a traveling sleeve 102, which is movable from a first, initial position, which is shown in FIG. 4, in the downhole direction 157 to a second position (e.g., a triggered position) shown in FIG. 6. In some embodiments, the traveling sleeve 102 may form a constriction in the longitudinal bore 151 of the expandable reamer apparatus 100. For example, the traveling sleeve 102 may include a constricted portion 104 (e.g., an orifice or a nozzle having a reduced cross-sectional area as compared to another portion of the longitudinal bore 151 of the expandable reamer apparatus 100) formed in a portion of the traveling sleeve 102. At relatively lower fluid flow rates of the drilling fluid through the longitudinal bore 151, the constricted portion 104 of the traveling sleeve 102 may allow fluid to pass therethrough. However, at a relatively higher fluid flow rate, the constricted portion 104 of the traveling sleeve 102 may start to limit the amount of fluid passing through the traveling sleeve 102.

The increased pressure at a proximal end of the constricted portion 104 of the traveling sleeve 102 and a decreased pressure at a distal end of the constricted portion 104 of the traveling sleeve 102 may form a pressure differential and may impart a force in the downhole direction 157 to the traveling sleeve 102. The force may translate the traveling sleeve 102 in the downhole direction 157. In some embodiments, the constricted portion 104 of the traveling sleeve 102 may be formed from a wear resistant material (e.g., cemented carbide) in order to reduce wear of the constricted portion 104 of the traveling sleeve 102 due to the drilling fluid passing therethrough.

In additional embodiments, other methods may be used to constrict fluid flow through the traveling sleeve 102 in order to move the traveling sleeve 102 in the downhole direction 157. For example, an obstruction may be selectively disposed within the traveling sleeve 102 to at least partially occlude fluid from flowing therethrough in order to apply a force in the downhole direction 157 to the traveling sleeve 102.

The traveling sleeve 102 may be at least partially received within a portion of the actuating feature of the reamer apparatus 100 (e.g., one or more of a portion of the push sleeve 115 and a portion of the latch sleeve 117). For example, the push sleeve 115 and the latch sleeve 117 may be cylindrically retained between the traveling sleeve 102 and the inner surface 112 (FIG. 5) of the tubular body 108 of the expandable reamer apparatus 100.

The push sleeve 115 may be retained in the initial position by the traveling sleeve 102. For example, a portion of the traveling sleeve 102 may act to secure a portion of the push sleeve 115 (or another component attached thereto such as, for example, the latch sleeve 117) to a portion of the inner wall 109 of the tubular body 108 of the expandable reamer apparatus 100. For example, the latch sleeve 117 may be coupled to the push sleeve 115 and may include one or more latch members 122 for engaging the inner wall 109 of the tubular body 108. The latch sleeve 117 may include one or more apertures 120 (e.g., apertures 120 extending laterally through the latch sleeve 117 relative to the longitudinal axis $L_{108}$ (FIG. 1) of the tubular body 108) having one or more latch members 122 disposed therein.

In some embodiments, the push sleeve 115 may be biased in the initial position (e.g., by a spring 116). For example, as shown in FIG. 4, the spring 116 may resist the motion of the push sleeve 115 in the uphole direction 159. In some embodiments, the expandable reamer apparatus 100 may be configured to preload the spring 116. For example, the spring 116 may be retained on the outer surface of the push sleeve 115 between the ring 130 attached in the shouldered portion 174 of the tubular body 108 and the latch sleeve 117. The latch sleeve 117 may be sized and positioned in the tubular body 108 about the traveling sleeve 102 such that the spring 116 is preloaded (i.e., compressed) between the latch sleeve 117 and the ring 130. In other words, the distance between the latch sleeve 117 and the ring 130 in the tubular body 108 is less than the distance of the spring 116 in its uncompressed state. When the spring 116 is inserted into the tubular body 108 a force is applied to the spring 116 to compress it between the latch sleeve 117 and the ring 130. The preloaded spring 116 will bias the push sleeve 115 and the latch sleeve 117 into their initial positions such that once the drilling fluid is ceased (i.e., after the expandable reamer apparatus 100 is returned to a retracted state after being in an extended state by reducing the drilling fluid flow). Stated in another way, the preloaded spring 116 will reposition the push sleeve 115 and the latch sleeve 117 with a force relatively greater than that of a non-preloaded spring. In some embodiments, the latch sleeve 117 may be coupled to the push sleeve 115 such that a distal end of the latch sleeve 117 is proximate to a distal end of the push sleeve 115 and may preload the spring 116.

In some embodiments, the spring 116 may be selected to exhibit a relatively large amount of force. For example, the spring 116 may be selected to have a size, configuration, or combinations thereof to exhibit relatively large amount of force in the downhole direction 157 when the spring 116 (e.g., the spring 116 in a loaded position as shown in FIG. 6) is returning the push sleeve 115 to its original, initial position. In some embodiments, the spring 116 exhibiting a relatively large amount of force may be preloaded as discussed above. Such a spring 116 may be selected to ensure the proper deactivation of the expandable reamer apparatus 100. That is, the spring 116, having a relatively large force exhibited by the loaded spring 116, will ensure that the blades 101 (FIG. 3) and the latch sleeve 117 may be returned to their initial position after activation of the expandable reamer apparatus 100 as discussed in greater detail below.

Referring still to FIG. 4, when the traveling sleeve 102 is in the initial position, the hydraulic pressure may act on the push sleeve 115, which is coupled the latch sleeve 117, between an outer surface of the traveling sleeve 102 and an inner surface of the tubular body 108. With or without hydraulic pressure, when the expandable reamer apparatus 100 is in the initial position, the push sleeve 115 is prevented from moving (e.g., in the uphole direction 159) by the latch members 122 of the latch sleeve 117. The latch members 122 may be retained between one or more grooves 124 (e.g., an annular groove) formed in the longitudinal bore 151 of the tubular body 108 (e.g., formed in the inner wall 109) by the traveling sleeve 102.

After the traveling sleeve 102 travels sufficiently far enough from the initial position in the downhole direction 157 (e.g., to a triggered position) to enable the latch members 122 of the latch sleeve 117 to be disengaged from the grooves 124 of the tubular body 108, the latch members 122 of the latch sleeve 117, which is coupled to the push sleeve 115, may all move in the uphole direction 159. In order for the push sleeve 115 to move in the uphole direction 159, the differential pressure between the longitudinal bore 151 and the outer surface 111 of the tubular body 108 caused by the hydraulic fluid flow must be sufficient to overcome the restoring force or bias of the spring 116.

Figure 5:
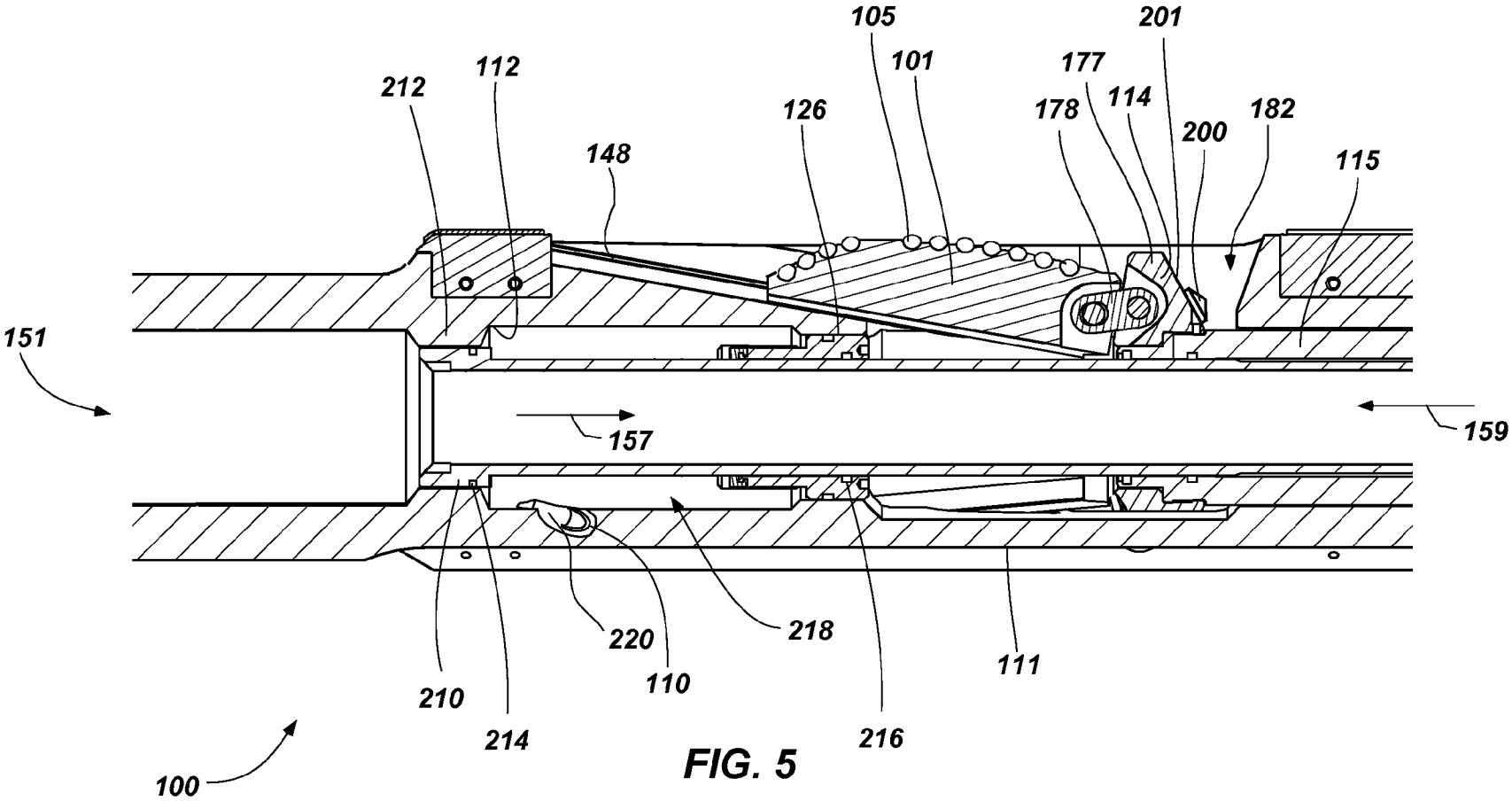
FIG. 5 shows an enlarged cross-sectional view of an uphole portion of an embodiment of an expandable reamer apparatus.

FIG. 5 shows an enlarged cross-sectional view of an uphole portion of an embodiment of an expandable reamer apparatus 100. As shown in FIG. 5, the push sleeve 115 includes, at its proximal end, a yoke 114 coupled to the push sleeve 115. The yoke 114 includes three arms 177, each arm 177 being coupled to one of the blades 101 by a pinned linkage 178. The pinned linkage 178 enables the blades 101 to rotationally transition about the arms 177 of the yoke 114 as the actuating means (e.g., the push sleeve 115, the yoke 114, and the linkage 178) transitions the blades 101 between the extended and retracted positions.

In some embodiments, a portion of the expandable reamer apparatus 100 (e.g., the arms 177 of the yoke 114) may include one or more surfaces or components (e.g., a wear-resistant insert) suitable for expelling debris as the blades 101 are transitioned between the extended and retracted positions (e.g., moved toward the retracted position in the downhole direction 157). For example, the arms 177 may include one or more surfaces having an apex or pointed end or an external component having an apex or pointed end attached to the arms 177 for removing (e.g., crushing, gouging, shearing, etc.) debris that may have formed proximate to the tubular body 108 of the expandable reamer apparatus 100. As shown in FIG. 5, each of the arms 177 may have a debris removal element 200 attached thereto (e.g., bonded thereto, formed thereon, etc.) for removing debris (e.g., debris from reaming a borehole with the blades 101). For example, the debris removal element 200 on the arms 177 may assist in dislodging and removing any packed-in shale, and may include low-friction surface material to prevent sticking by formation cuttings and other debris. The debris removal element 200 may be positioned on a downhole surface 201 of the yoke 114 (i.e., a surface of the yoke oriented in the downhole direction 157). For example, the debris removal element 200 may by positioned in a central area of the downhole surface 201 of the yoke 114 (e.g., away from the edges or edge portions of the downhole surface 201 of the yoke 114). The debris removal element 200 may include the one or more surfaces having an apex or pointed end to create a surface having a relative small surface area. As pressure is the force per unit area, such a surface may enable a high pressure to be applied by the debris removal element 200 at the apex or pointed end to debris when the yoke 114 is forced in the downhole direction 157 by the spring 116. In some embodiments, the debris removal element 200 may be formed from a material that is relatively hard and resistant to wear (e.g., metallic materials, composite materials, diamond enhanced materials, etc.). In other embodiments, a surface of the tubular body 108 may include one or more surfaces or components suitable for expelling debris as the blades 101 are transitioned between the extended and retracted positions. For example, the tubular body 108 may include an integral or external debris removal element 250 having an apex or pointed end as shown in FIG. 6. In yet other embodiments, both the tubular body 108 and the arms 177 of the yoke 114 may include debris removal element 200.

When the blades 101, the yoke 114, the push sleeve 115, and the latch sleeve 117 are to be returned to their initial position after activation of the expandable reamer apparatus 100 (as shown in FIG. 6), debris (e.g., debris from reaming the borehole or other downhole activity) may tend to become lodged in a portion of the expandable reamer apparatus 100 (e.g., along the tracks 148, in a blade passage port 182 (FIG. 5), etc.). Such debris may prevent the blades 101 from being properly retracted after being extended. As discussed above, when the blades 101 are to be retracted (e.g., fluid flow through the expandable reamer apparatus 100 is reduced to or below a predetermined level), the blades 101, yoke 114, push sleeve 115, and latch sleeve 117 will be forced in the downhole direction 157 by the spring 116 (e.g., the spring 116 exhibiting a relatively large amount of force in a loaded position when the blades 101 are extended). The yoke 114 having the debris removal elements 200 attached thereto is forced by the spring 116 through the debris and may act to remove debris that would otherwise inhibit the blades 101 from being moved to the retracted position.

Referring still to FIG. 5, the expandable reamer apparatus 100 may include nozzle assemblies 110 (e.g., tungsten carbide nozzles). The nozzle assemblies 110 may be provided to cool and clean the cutting elements 105 and clear debris from blades 101 during drilling. In some embodiments, the nozzle assemblies 110 may be configured to direct drilling fluid toward the blades 101 in the downhole direction 157. For example, the nozzle assemblies 110 may be directed in the direction of flow through the expandable reamer apparatus 100 from within the tubular body 108 downward and outward radially to the annulus between tubular body 108 and a borehole. Directing the nozzle assemblies 110 in such a downward direction causes counterflow as the flow exits the nozzle and mixes with the annular moving counterflow returning up the borehole and may improve blade cleaning and cuttings removal. In other embodiments, the nozzle assemblies 110 may be configured to direct fluid laterally or in the uphole direction 159.

In some embodiments, the expandable reamer apparatus 100 may restrict communication of the drilling fluid flowing through the longitudinal bore 151 of the expandable reamer apparatus 100 with the nozzle assemblies 110. For example, portions of the reamer apparatus 100 may prevent drilling fluid from flowing to one or more of the nozzle assemblies 110. In some embodiments, a portion of the traveling sleeve 102 may act to restrict fluid flow to the nozzle assemblies 110. For example, the traveling sleeve 102 may extend in the uphole direction 159 to a location proximate to the blades 101 and tracks 148. As shown in FIG. 5, the traveling sleeve 102 may extend in the uphole direction 159 through a portion of the tubular body 108 (e.g., a seal sleeve 126 disposed in the tubular body 108) and to a location axially past the nozzle assemblies 110 in the uphole direction 159. At an uphole portion of the expandable reamer apparatus 100, a proximal portion 210 (i.e., an uphole portion) of the traveling sleeve 102 may form a seal with a portion of the body 108 of the expandable reamer apparatus 100. For example, the proximal portion 210 of the traveling sleeve 102 may form a seal with the protruding portion 212 of the body 108 of the expandable reamer apparatus 100. At a distal portion (i.e., a downhole portion) of the expandable reamer apparatus 100, a portion of an outer surface of the traveling sleeve 102 may form a seal with a portion of the seal sleeve 126.

In some embodiments, one of the body 108 of the expandable reamer apparatus 100 and the proximal portion 210 of the traveling sleeve 102 may have an O-ring seal disposed in a groove (e.g., seal 214) to prevent fluid from flowing between the protruding portion 212 of the body 108 of the expandable reamer apparatus 100 and the proximal portion 210 of the traveling sleeve 102. In a similar manner, one of the seal sleeve 126 and the traveling sleeve 102 may have an O-ring seal disposed in a groove (e.g., seal 216) to prevent fluid from flowing between the seal sleeve 126 and the traveling sleeve 102. It is noted that while the embodiment of FIG. 5 illustrates the seals being formed by the traveling sleeve 102 and the body 108 (FIG. 4) of the expandable reamer apparatus 100 at one end and the seal sleeve 126 and traveling sleeve 102 at another end, the nozzle assemblies 110 may be sealed off from fluid in any suitable configuration. For example, the traveling sleeve 102 may form a seal with the body 108 at both ends, the traveling sleeve 102 may form a seal with sealing sleeves at both ends, or combinations thereof.

The seals formed between components of the expandable reamer apparatus 100 proximate to the nozzle assemblies 110 (e.g., by the combination of the traveling sleeve 102, the body 108 of the expandable reamer apparatus 100, and the seal sleeve 126) may form an annulus 218 proximate to an inlet 220 of the nozzle assemblies 110. As shown in FIG. 5, the annulus 218 is substantially sealed off from the fluid flowing through the longitudinal bore 151 of the expandable reamer apparatus 100 when the traveling sleeve 102 is in the initial position. When the traveling sleeve 102 moves downward (e.g., under the force from the fluid flowing therethrough as discussed below and shown in FIG. 6), the annulus 218 may be exposed to the fluid flowing through the longitudinal bore 151 of the expandable reamer apparatus 100 and fluid may pass to the inlets 220 of the nozzle assemblies 110 and out of the body 108 of the expandable reamer apparatus 100 through the nozzle assemblies 110.

In such an embodiment, downward movement of the traveling sleeve 102 during activation of the expandable reamer apparatus 100, as discussed below, may also be indicated by enabling fluid flow to the nozzle assemblies 110. For example, once the traveling sleeve 102 has traveled in the downhole direction 157 a sufficient distance to enable fluid flow to the nozzle assemblies 110, a signal in the form of, for example, a detectable or measurable pressure or change in pressure of drilling fluid within the borehole due to fluid flow through the nozzle assemblies 110 may, as sensed by the operator, indicate that the expandable reamer apparatus 100 has been activated. Stated in another way, when fluid flow through the nozzle assemblies 110 is enabled, the fluid pressure within the expandable reamer apparatus 100 will decrease as fluid is directed out of the expandable reamer apparatus 100 through the nozzle assemblies 110 and into the borehole.

In other embodiments, (e.g., as shown in FIG. 6) the nozzle assemblies 110 may be exposed to fluid flowing through the longitudinal bore 151 of the expandable reamer apparatus 100 regardless of the position of the traveling sleeve 102 or whether the blades 101 are expanded or retracted. Such an embodiment may enable fluid to flow proximate to the blades 101 while fluid is pumped through the expandable reamer apparatus 100 and may act to reduce debris buildup on the blades 101 and other outer components of the expandable reamer apparatus 100 and may prevent debris from clogging the nozzle assemblies 110.

Referring now to FIGS. 4 and 6, the expandable reaming apparatus 100 is now described in terms of its operational aspects. Before "triggering" the expandable reamer apparatus 100 to the expanded position, the expandable reamer apparatus 100 is maintained in an initial, retracted position as shown in FIG. 4. While the traveling sleeve 102 is in the initial position, the blade actuating feature (e.g., the push sleeve 115) is prevented from actuating the blades 101. When it is desired to trigger the expandable reamer apparatus 100, the traveling sleeve 102 is moved in the downhole direction 157 to release the latch members 122 of the latch sleeve 117. For example, the rate of flow of drilling fluid through the reamer apparatus 100 is increased to increase the hydraulic pressure at the constricted portion 104 of the traveling sleeve 102 and to exert a force (e.g., a force due to a pressure differential) against the traveling sleeve 102 and translate the traveling sleeve 102 in the downhole direction 157.

As shown in FIG. 6, the traveling sleeve 102 may travel sufficiently far enough from the initial position in the downhole direction 157 to enable the latch members 122 of the latch sleeve 117 to be disengaged from the groove 124 of the tubular body 108. The latch sleeve 117, coupled to the pressure-activated push sleeve 115, may move in the uphole direction 159 under fluid pressure influence (e.g., from fluid supplied through orifices in one or more of the latch sleeve 117 (e.g., scallops 136), the traveling sleeve 102, and the ring 113). As the fluid pressure is increased by the increased fluid flow, the biasing force of the spring 116 is overcome enabling the push sleeve 115 to move in the uphole direction 159. Movement of the push sleeve 115 in the uphole direction 159 may move the yoke 114 and the blades 101 in the uphole direction 159. In moving in the uphole direction 159, the blades 101 each follow a ramp or track 148 to which they are mounted (e.g., via a type of modified square dovetail groove 179 (FIG. 2)).

As also shown in FIG. 6, when the traveling sleeve 102 moves downward under the force from the fluid flowing therethrough, the annulus 218 may be exposed to the fluid flowing through the longitudinal bore 151 of the expandable reamer apparatus 100 (e.g., through the opening formed between the proximal portion 210 of the traveling sleeve 102 and the protruding portion 212 of the body 108 of the expandable reamer apparatus 100). Fluid may pass into the annulus 218 and to the nozzle assemblies 110.

Whenever the flow rate of the drilling fluid passing through the traveling sleeve 102 is decreased below a selected flow rate value, the traveling sleeve 102 may be returned to the initial position shown in FIG. 4 under the biasing force of spring 116. As the traveling sleeve 102 returns to the initial position, the latch sleeve 117 and the latch members 122 may return to the initial position and the traveling sleeve 102 may again secure the latch members 122 in the groove 124 of the tubular body 108. The push sleeve 115, the yoke 114, the blades 101, and the latch sleeve 117 may also be returned to their initial or retracted positions under the force of the spring 116. The opening formed between the proximal portion 210 of the traveling sleeve 102 and the protruding portion 212 of the body 108 of the expandable reamer apparatus 100 is sealed and fluid flow to the annulus 218 and nozzle assemblies 110 may again be restricted.

In some embodiments, one of the body 108 of the expandable reamer apparatus 100 and the proximal portion 210 of the traveling sleeve 102 may have an O-ring seal disposed in a groove (e.g., seal 214) to prevent fluid from flowing between the protruding portion 212 of the body 108 of the expandable reamer apparatus 100 and the proximal portion 210 of the traveling sleeve 102. In a similar manner, one of the seal sleeve 126 and the traveling sleeve 102 may have an O-ring seal disposed in a groove (e.g., seal 216) to prevent fluid from flowing between the seal sleeve 126 and the traveling sleeve 102. It is noted that while the embodiment of FIG. 5 illustrates the seals being formed by the traveling sleeve 102 and the body 108 (FIG. 4) of the expandable reamer apparatus 100 at one end and the seal sleeve 126 and traveling sleeve 102 at another end, the nozzle assemblies 110 may be sealed off from fluid in any suitable configuration. For example, the traveling sleeve 102 may form a seal with the body 108 at both ends, the traveling sleeve 102 may form a seal with sealing sleeves at both ends, or combinations thereof.

Referring back to FIG. 3, in some embodiments, a protect sleeve 222 may be disposed within the longitudinal bore 151 of the expandable reamer apparatus 100. For example, the protect sleeve 222 may extend along a portion of the body 108 of the expandable reamer apparatus 100 within the longitudinal bore 151 proximate to the push sleeve 115. In some embodiments, the protect sleeve 222 may be abutted with the ring 113 that retains one end of the spring 116.

The protect sleeve 222 may be formed from a material that is relatively hard and resistant to wear (e.g., metallic materials, composite materials, diamond enhanced materials, etc.) and may protect inner surfaces of the body 108 of the expandable reamer apparatus 100 from wear caused to the inner surfaces of the expandable reamer apparatus 100 during downhole drilling activity. For example, the protect sleeve 222 may enable the push sleeve 115 to slide on an inner surface of the protect sleeve 222 as the expandable reamer apparatus 100 is moved between the expanded and retracted positions. The push sleeve 115 may form a seal with the protect sleeve 222 (e.g., at seal 224). The protect sleeve 222 may also protect portions of inner surface of the body 108 from wear caused by the drilling fluid flowing through the expandable reamer apparatus 100. In some embodiments, the protect sleeve 222 may be secured to the body 108 of the expandable reamer apparatus 100 with a sealed screw. In some embodiments, the protect sleeve 222 may include one or more seals (e.g., O-ring seals 226) for sealing the outer surface of the protect sleeve 222 to the inner surface of the body 108 of the expandable reamer apparatus 100.

The protect sleeve 222 may be easily removed from the longitudinal bore 151 of the expandable reamer apparatus 100 and replaced when desirable. Such a configuration including the protect sleeve 222 may enable the expandable reamer apparatus 100 to have a relatively longer use life by enabling high wear and use areas of the longitudinal bore 151 of the expandable reamer apparatus 100 to be replaced.

Figure 7:
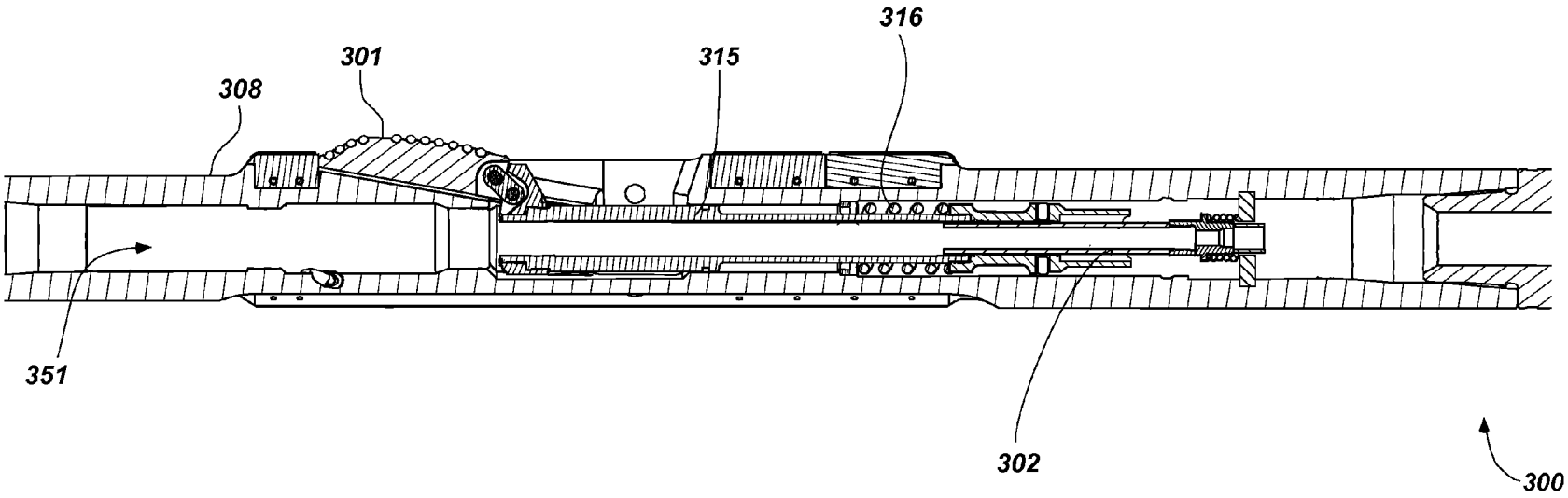
FIG. 7 shows a partial, longitudinal cross-sectional illustration of yet another embodiment of an expandable reamer apparatus in an expanded position.

As shown in FIG. 7, an expandable reamer apparatus 300 may be sized to have longitudinal bore 351 that is relatively smaller than similar expandable apparatus (e.g., the expandable reamer apparatus 100). For example, the longitudinal bore 351 and the components disposed within the longitudinal bore 351 (e.g., the traveling sleeve 302, the push sleeve 315, the spring 316, etc.) may have a lateral dimension (e.g., a diameter) that is relatively smaller than similar expandable apparatus. Stated in another way, generally, an expandable reamer apparatus is configured to produce (i.e., ream) a borehole that is approximately twenty percent (20%) larger in diameter than the borehole before reaming (e.g., the diameter of the borehole produced by a pilot drill bit). The longitudinal bore 351 and the components disposed within the longitudinal bore 351 may be sized relatively smaller enabling relatively larger blades 301 to be implemented with the expandable reamer apparatus 300. In other words, the relatively smaller longitudinal bore 351 and the components disposed within the longitudinal bore 351 enable relatively larger blades 301 to be positioned within the body 308 of the expandable reamer apparatus 300 in a retracted position. The relatively larger blades 301 may enable the expandable reamer apparatus 300 to produce a borehole that is approximately greater than twenty percent (20%) larger (e.g., 30% larger, 40% larger, 50% larger, etc.) in diameter than the borehole before reaming. For example, the relatively larger blades 301 may enable the expandable reamer apparatus 300 to produce a borehole that is approximately greater than fifty percent (50%) larger in diameter than the borehole before reaming.

Embodiments of the present disclosure may be particularly useful in providing a relatively more reliable and robust expandable apparatus. For example, an expandable apparatus may include components and mechanisms ensuring proper expansion and retraction of the expandable members and removal of debris proximate the expandable members. Further, an expandable apparatus may include internal components enabling the use of relative larger expandable members. Even further still, an expandable apparatus may include internal components enabling fluid flow through nozzle assemblies at selected times including constant flow through the nozzle assemblies. Finally, an expandable apparatus may include replaceable internal components that may increase the use life of the expandable apparatus as compared to similar expandable apparatus.

While particular embodiments of the disclosure have been shown and described, numerous variations and other embodiments will occur to those skilled in the art. Accordingly, it is intended that the disclosure only be limited in terms of the appended claims and their legal equivalents.

What is claimed is:

1. An expandable apparatus for use in a subterranean borehole, comprising:

a tubular body having a longitudinal bore and at least one opening in a wall of the tubular body;

at least one member positioned within the at least one opening in the wall of the tubular body, the at least one member configured to move between a retracted position and an extended position; and a yoke coupled to the at least one member, the yoke comprising at least one surface having a central portion comprising an apex for removing debris proximate to the at least one opening in the wall of the tubular body, wherein the apex is positioned on the yoke at the central portion spaced from any edge portions of a downhole surface of the yoke.

2. The expandable apparatus of claim 1, further comprising a spring disposed within the longitudinal bore of the tubular body configured to bias the yoke and the at least one member coupled thereto toward the retracted position.

3. The expandable apparatus of claim 2, wherein the spring is sized and configured to impart a bias force to the yoke toward the retracted position having a magnitude sufficient to permit removal of debris proximate to the yoke during movement of the at least one member from the extended position to the retracted position.

4. The expandable apparatus of claim 1, wherein the at least one member comprises at least three members, each member of the at least three members being positioned within a respective opening formed in the tubular body, and wherein the yoke further comprises at least three arms each having at least one surface having a central portion comprising an apex for removing debris, each arm of the at least three arms coupled to one of the at least three members.

5. The expandable apparatus of claim 1, wherein the at least one surface having the apex for removing debris comprises an integral surface of the yoke.

6. The expandable apparatus of claim 1, wherein the apex is positioned on the expandable apparatus to orient the apex in a downhole direction when the expandable apparatus is deployed in a subterranean wellbore.

7. The expandable apparatus of claim 1, wherein the at least one surface is positioned on the yoke to extend from the yoke in a downhole direction when the expandable apparatus is deployed in a subterranean wellbore and terminate at the apex.

8. An expandable apparatus for use in a subterranean borehole, comprising:

a tubular body having a longitudinal bore and at least one opening in a wall of the tubular body;

at least one member positioned within the at least one opening in the wall of the tubular body, the at least one member configured to move between a retracted position and an extended position; and a yoke coupled to the at least one member, at least one of the yoke and the tubular body comprising at least one surface having a central portion comprising an apex for removing debris proximate to the at least one opening in the wall of the tubular body, wherein the at least one surface having the apex for removing debris comprises a debris removal element coupled to a surface of at least one of the yoke and the tubular body.

9. The expandable apparatus of claim 8, wherein the debris removal element comprises a wear resistant material.

10. A method for operating an expandable apparatus for use in a subterranean borehole, comprising:

moving at least one member of the expandable apparatus coupled to a yoke from a retracted position to an extended position against a biasing force of a spring disposed in the expandable apparatus to compress the spring;

forcing the at least one member and the yoke from the extended position to the retracted position with the biasing force of the spring; and removing debris from an exterior of the expandable apparatus proximate to the at least one member with at least one surface of the yoke having a central portion comprising an apex and with the biasing force of the spring comprising contacting the debris with the apex of the at least one surface of the yoke that is spaced from any edge portions of a downhole surface of the yoke.

11. The method of claim 10, further comprising reaming the subterranean borehole with the at least one member of the expandable apparatus to a diameter that is at least twenty-five percent (25%) greater than a diameter of the subterranean borehole before reaming.

12. An expandable apparatus for use in a subterranean borehole, comprising:

a tubular body having a longitudinal bore and at least one opening in a wall of the tubular body;

at least one member positioned within the at least one opening in the wall of the tubular body, the at least one member configured to move between a retracted position and an extended position; and a yoke coupled to the at least one member, the tubular body comprising at least one surface having a central portion comprising an apex for removing debris proximate to the at least one opening in the wall of the tubular body, wherein the at least one surface is positioned on the tubular body to extend from the tubular body in an uphole direction when the expandable apparatus is deployed in a subterranean wellbore and terminate at the apex.

13. A method for operating an expandable apparatus for use in a subterranean borehole, comprising:

moving at least one member of the expandable apparatus coupled to a yoke from a retracted position to an extended position;

forcing the at least one member and the yoke from the extended position to the retracted position;

contacting the debris with an apex formed on a central portion of an arm of the yoke proximate a coupling between the arm and the at least one member; and removing debris from an exterior of the expandable apparatus proximate to the at least one member with at least one protruding surface of at least one of the yoke and the tubular body.

14. The method of claim 13, wherein moving at least one member of the expandable apparatus coupled to a yoke from a retracted position to an extended position comprises compressing a spring disposed in the expandable apparatus.

15. The method of claim 14, wherein forcing the at least one member and the yoke from the extended position to the retracted position comprises expanding the spring.

* * * * *